US005516310A

United States Patent [19]

Sawada

[11] Patent Number: 5,516,310

[45] Date of Patent: May 14, 1996

[54] SOCKET TERMINAL

[75] Inventor: Yoshitsugu Sawada, Shizuoka, Japan

[73] Assignee: Yazaki Corporation, Tokyo, Japan

[21] Appl. No.: 242,852

[22] Filed: May 16, 1994

[30] Foreign Application Priority Data

May 14, 1993 [JP] Japan ..... 5-135061

[51] Int. Cl.[6] ..... H01R 13/187

[52] U.S. Cl. ..... 439/843

[58] Field of Search ..... 439/839–843, 439/851

[56] References Cited

U.S. PATENT DOCUMENTS

| | | | |
|---|---|---|---|
| 4,168,878 | 9/1979 | Risser et al. | 439/839 |
| 4,447,110 | 5/1984 | Punako et al. | 439/843 |
| 4,461,530 | 7/1984 | Brush, Sr. et al. | 439/843 |
| 4,461,531 | 7/1984 | Davis et al. | 439/843 |
| 4,671,586 | 6/1987 | DeBolt | 439/126 |
| 4,734,064 | 3/1988 | Knapp et al. | 439/852 |
| 4,921,456 | 5/1990 | French | 439/851 |
| 5,135,418 | 8/1992 | Hatagishi et al. | 439/851 |

FOREIGN PATENT DOCUMENTS

| | | | |
|---|---|---|---|
| 0123096 | 10/1984 | European Pat. Off. . | |
| 0274012 | 7/1988 | European Pat. Off. | 439/843 |
| 59-184476 | 10/1984 | Japan . | |
| 63-102182 | 5/1988 | Japan . | |
| 3291874 | 12/1991 | Japan | 439/843 |
| 410972 | 1/1992 | Japan . | |

*Primary Examiner*—P. Austin Bradley
*Assistant Examiner*—Jill DeMello
*Attorney, Agent, or Firm*—Sughrue, Mion, Zinn, Macpeak & Seas

[57] ABSTRACT

In a female terminal body, a plurality of elastic contact pieces by which a male terminal is to be clamped and which are separated from each other in a peripheral direction by slits elongating in a longitudinal direction are disposed in a front part, and a cylindrical base portion for fixing a sleeve is formed in a middle part. On the cylindrical base portion, four grooves which are long grooves elongating in the axial direction and arranged in the peripheral direction at equal intervals, and an annular step portion for receiving the sleeve are formed. On the other hand, the sleeve which is a circular cylindrical protection member opens at the rear end so that the sleeve can be fitted onto the cylindrical base portion. Four beads which project toward the inside of the sleeve are formed in such a manner that they elongate with starting from the opening in the axial direction. The beads are disposed so as to respectively correspond to the grooves of the cylindrical base portion. A terminal insertion hole which functions as an insertion hole for the male terminal is formed at the front end of the sleeve.

4 Claims, 3 Drawing Sheets

SOCKET TERMINAL

BACKGROUND OF THE INVENTION

1. Field of the Invention

The invention relates to a socket terminal in which the front ends of plural elastic contact pieces for clamping a male terminal are prevented from being misaligned in a fitting process with respect to a protection sleeve to be fitted onto the elastic contact pieces.

2. Prior Art

Conventionally, as a generally used socket terminal, known is a round-pin terminal having a circular cylindrical shape and disclosed in, for example, Unexamined Japanese Patent Publication No. sho. 63-102182. The round-pin terminal has an excellent workability because it has no particular limitations other than the connecting direction.

As shown in FIG. 8, a terminal body 1 of a female terminal F consists of a plurality of elastic contact pieces 2 which are separated from each other in a peripheral direction by slits elongating in a longitudinal direction, a cylindrical base portion 3 onto which a protection member is to be fitted, a conductor clamping portion 4 to which an electric wire W is to be fixed, and a cover clamping portion 7. The elastic contact pieces 2 are disposed in a front part of the terminal body 1, the cylindrical base portion 3 in a middle part, and the conductor clamping portion 4 and the cover clamping portion 7 in a rear part. The terminal body 1 is formed by punching a flat conductive material and plastic-deforming the punched material into a cylindrical shape. In order to facilitate the insertion of a male terminal M, the front ends of the elastic contact pieces 2 are bent outward.

A circular cylindrical protection sleeve 5 is fitted onto the cyllindrical base portion 3, thereby protecting the elastic contact pieces 2. The sleeve 5 has a terminal insertion hole **5*b* at the front end. The fitting of the sleeve 5 onto the cylindrical base portion 3 is performed by inserting the elastic contact pieces 2 into the sleeve from an opening at the rear end until a stopper 3*a* of the cylindrical base portion 3 contacts with the opening edge of the sleeve 5. Then, the sleeve 5 is caulked against the cylindrical base portion 3 and a concave portion 5*a* is formed, thereby preventing the sleeve 5** from slipping off.

The male terminal M is made of a rod-like conductive material. When the connection direction is determined, the male terminal M can easily be inserted into the sleeve 5 through the terminal insertion hole **5*b* formed in the sleeve 5, to be clamped by the elastic contact pieces 2, with the result that the male terminal M is fitted into the female terminal body 1**, thereby accomplishing an electrical connection.

In the thus configured socket terminal of the prior art, the sleeve 5 must be caulked. As shown in FIG. 9, therefore, there may arise a case where an excessive force is applied during the caulking process to the concave portion **5*a* to erroneously bend the sleeve 5 and the elastic contact pieces 2, so that an irregular gap 6 is formed therebetween. As a result, the terminal insertion hole 5*b* of the sleeve 5 is misaligned with respect to the front ends of the elastic contact pieces 2, so that, when the male terminal M is inserted into the female terminal F, the male terminal M is not properly clamped between the elastic contact pieces 2**. This produces problems such as that the female terminal F is deformed, and that the terminal fitting cannot be performed properly.

SUMMARY OF THE INVENTION

The invention has been conducted in view of the problems in the prior art. It is an object of the invention to provide a socket terminal in which a cylindrical base portion of a female terminal body can be inserted into a sleeve without misaligning their axes.

The above-mentioned object of the invention can be attained by a socket terminal comprising: a terminal body having a cylindrical base portion in a front part, and a wire connection portion in a rear part, the cylindrical base portion having a plurality of elastic contact pieces which are separated from each other in a peripheral direction by slits elongating in a longitudinal direction, a wire being to be connected to the wire connection portion; and a circular cylindrical protection sleeve having a terminal insertion hole at a front part, and a fitting portion at a rear part, the protection sleeve being fitted onto the cylindrical base portion, wherein a plurality of grooves elongating in an axial direction are formed on an outer face of the cylindrical base portion of the terminal body, and a plurality of beads respectively corresponding to the grooves are formed on an inner face of the fitting portion of the sleeve.

Furthermore, the object can be attained by a configuration wherein the beads projecting from the inner face of the fitting portion of the sleeve have elasticity.

Moreover, the object can be attained by a configuration wherein a diameter of a bead circle which passes apexes of the beads is slightly smaller than that of a groove circle which passes bottoms of the grooves.

In the socket terminal of the invention, a plurality of grooves elongating in the axial direction are formed on the outer face of the cylindrical base portion of the terminal body, and a plurality of beads respectively corresponding to the grooves are formed on the inner face of the protection sleeve. When the sleeve is fitted onto the cylindrical base portion of the terminal body, therefore, the grooves are inserted along the respective beads so that the fitting of the sleeve onto the cylindrical base portion is accomplished without misaligning the axes of the sleeve and terminal body. Consequently, misalignment between the front ends of the elastic contact pieces which elongate from the cylindrical base portion, and the terminal insertion hole of the sleeve does not occur, resulting in that socket female and male terminals can be fittingly connected to each other in a satisfactory manner.

DETAILED DESCRIPTION OF THE PREFERRED EMBODIMENTS

Figure 1:
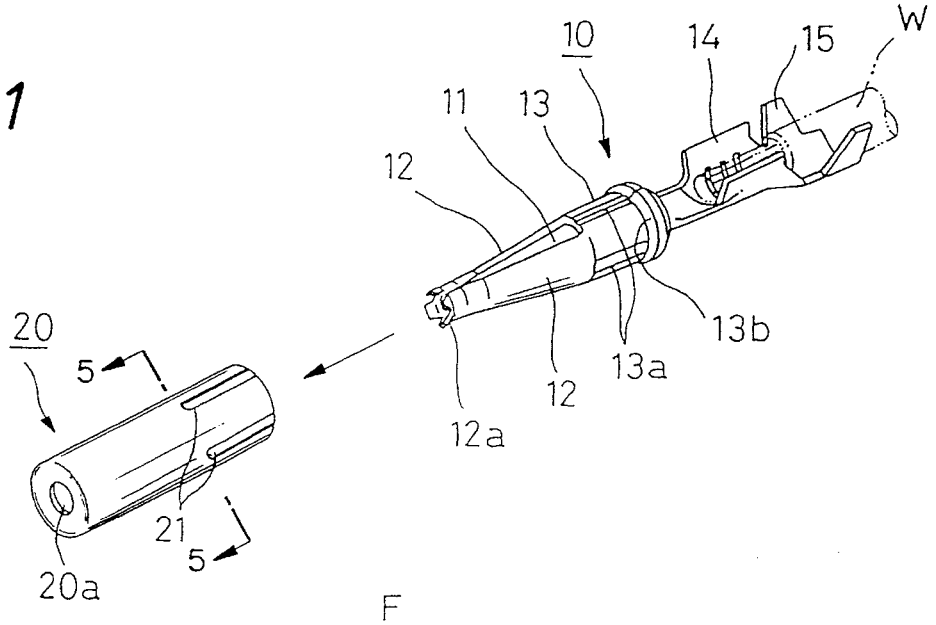
FIG. 1 is an exploded perspective view of a socket terminal of an embodiment of the invention.
Figure 2:
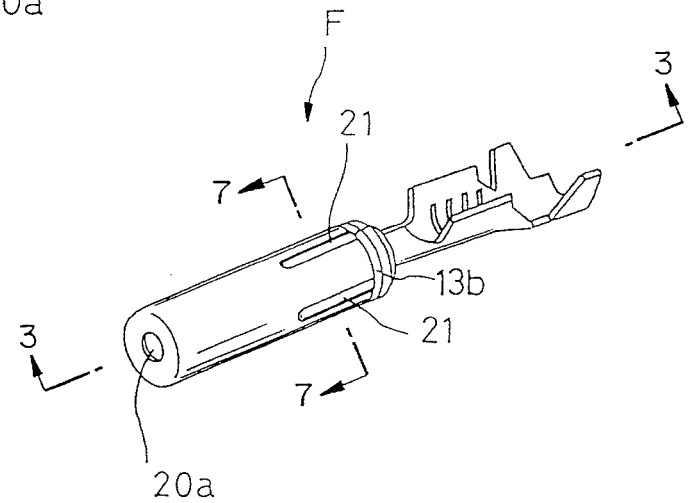
FIG. 2 is a perspective view of the socket terminal onto which a sleeve is fitted.
Figure 3:
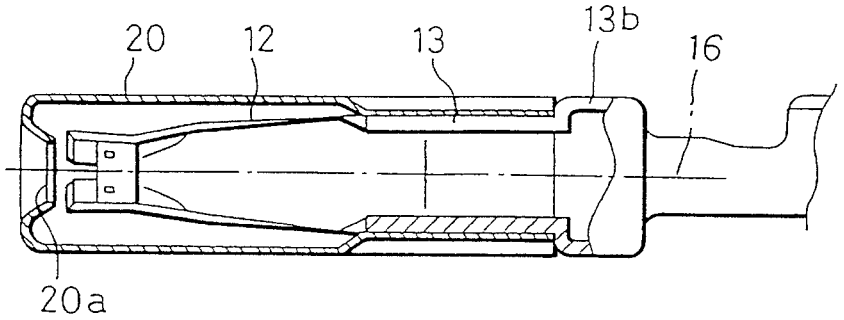
FIG. 3 is a section view taken along line W—W of FIG. 2.
Figure 5:
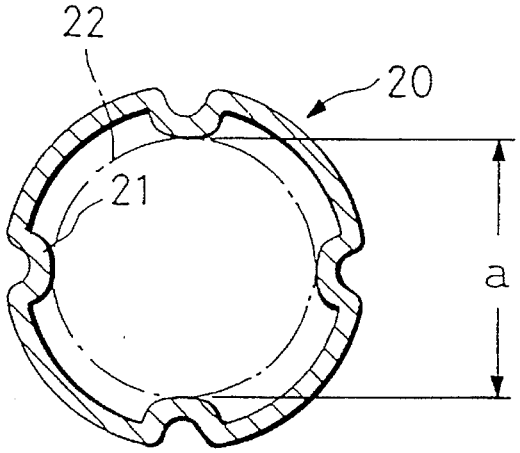
FIG. 5 is a section view taken along line Z—Z of FIG. 1.
Figure 6:
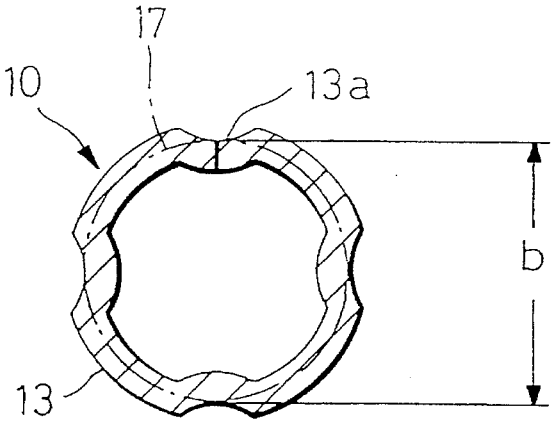
FIG. 6 is a section view taken along line Y—Y of FIG. 4.
Figure 7:
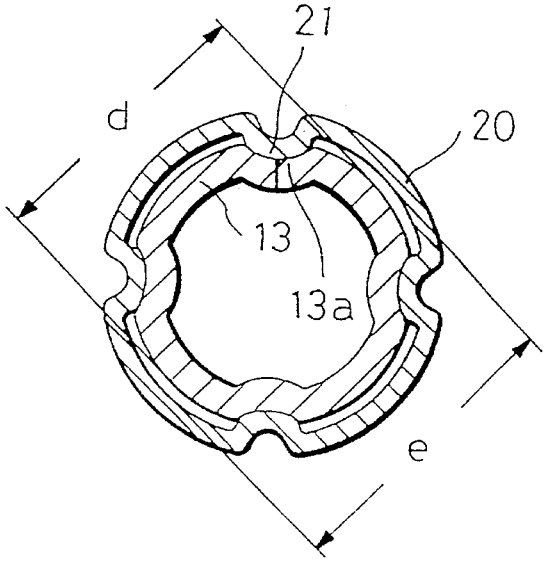
FIG. 7 is a section view taken along line X—X of FIG. 2.
Figure 8:
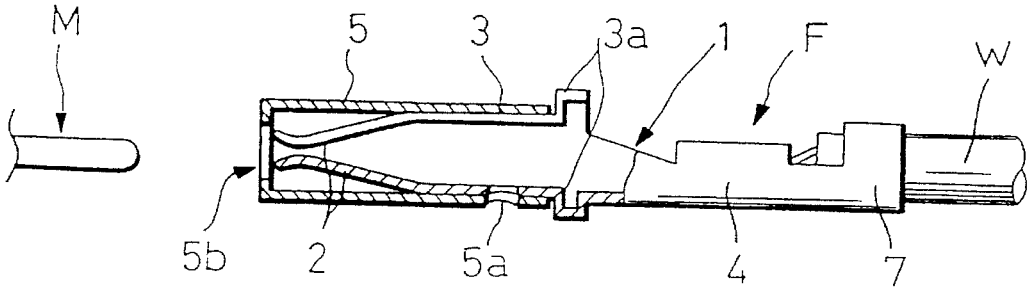
FIG. 8 PRIOR ART
FIG. 8 is a partial section view of a conventional art example.
Figure 9:
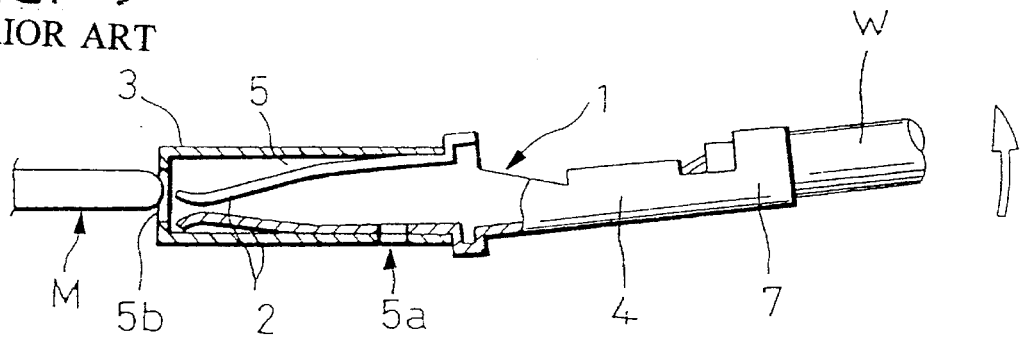
FIG. 9 PRIOR ART
FIG. 9 is a partial section view showing a state in which the conventional art example of FIG. 8 is subjected to an external force.

Hereinafter, a socket terminal which is an embodiment of the invention will be described with reference to FIGS. 1 to 7. FIG. 1 is an exploded perspective view of a socket female terminal of the embodiment of the invention, FIG. 2 is a perspective view of the socket female terminal onto which a sleeve is fitted, FIG. 3 is a section view taken along line W—W of FIG. 2, FIG. 4 is a plan view of the female terminal body, FIG. 5 is a section view taken along line Z—Z of FIG. 1, FIG. 6 is a section view taken along line Y—Y of FIG. 4, and FIG. 7 is a section view taken along line X—X of FIG. 2.

As shown in FIG. 1, the female terminal body 10 comprises a plurality of elastic contact pieces 12 by which a male terminal is to be clamped and which are separated from each other in a peripheral direction by slits 11 elongating in a longitudinal direction, a cylindrical base portion 13 for fixing a sleeve, a wire clamping portion 14, and a wire cover clamping portion 15. The elastic contact pieces 12 are disposed in a front part of the terminal body 10, the cylindrical base portion 13 in a middle part, and the wire clamping portion 14 and the wire cover clamping portion 15 in a rear part.

Figure 4:
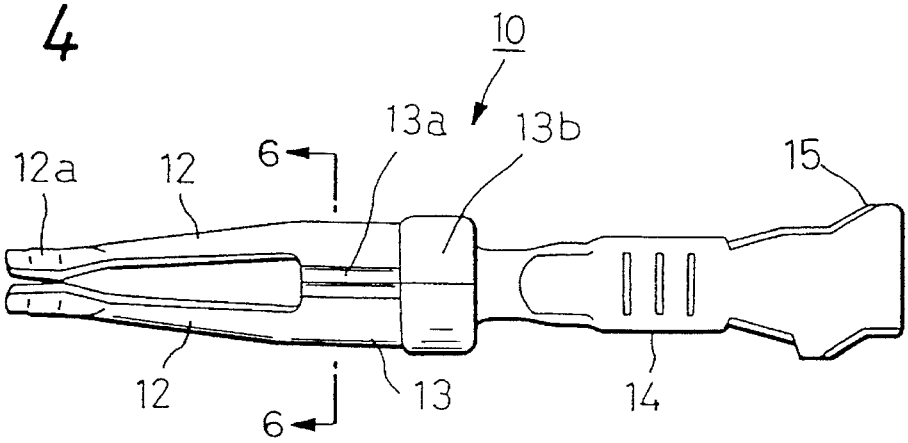
FIG. 4 is a plan view of the terminal body of the present invention.

As shown in FIG. 4, the elastic contact pieces 12 elongating from the cylindrical base portion 13 constitute a cylinder having a diameter which gradually decreases as moving more distant from the cylindrical base portion 13, so that the male terminal is pressingly contacted to and clamped by their front ends 12*a*. Four grooves 13*a*, and an annular step portion 13*b* for receiving the sleeve are formed on the cylindrical base portion 13. The grooves 13*a* are long grooves elongating in the axial direction and arranged in the peripheral direction at equal intervals.

On the other hand, the sleeve 20 which is a circular cylindrical protection member opens at the rear end so that the sleeve can be fitted onto the cylindrical base portion 13. Four beads 21 which project toward the inside of the sleeve 20 are formed in such a manner that they elongate with starting from the opening in the axial direction. The beads 21 are disposed so as to respectively correspond to the grooves 13*a* of the cylindrical base portion 13. A terminal insertion hole 20*a* which functions as an insertion hole for the male terminal is formed at the front end of the sleeve 20.

As shown in FIGS. 2 and 3, the female terminal body 10 is inserted from the opening at the rear end of the sleeve 20 and then advanced until the annular step portion 13*b* contacts with the opening edge at the rear end of the sleeve 20, thereby completing the fitting. Under this state, the axes of the sleeve 20 and cylindrical base portion 13 are made coincident with the axis 16 by the fitting of the beads 21 and the grooves 13*a*. Consequently, the axis 16 passes through the center of the terminal insertion hole 20*a* for the male terminal (not shown) which hole is formed at the front end of the sleeve 20, and therefore the male terminal may be correctly inserted and fitted into the center of the female terminal F.

As shown in FIGS. 5 and 6, the beads 21 are disposed at positions opposing to each other and in the total number of four. At corresponding positions outside the sleeve 20, the beads 21 constitute grooves having a U-like section. The beads 21 are formed to be integral with the sleeve 20 in such a manner that the beads are substantially equal in thickness to the sleeve 20. Consequently, the beads 21 can elastically deform against a stress acting in an outward direction, so that the sleeve 20 can be deformed by elasticity to increase the diameter and conversely a restoring force acts on the sleeve 20 in a direction toward the center.

In contrast, the female terminal body 10 is formed by punching a flat conductive material and plastic-deforming the punched material into a cylindrical shape. In this processing, the grooves 13*a* which are long U-like grooves are formed on the outer face of the cylindrical base portion 13 by plastic deformation in the same manner as the beads 21, or at positions opposing to each other and in the total number of four.

The beads 21 and the grooves 13*a* are formed so as to have the following dimensional relationships. That is, the diameter a of a bead circle 22 which passes the apexes of the beads 21 is slightly smaller than the diameter b of a groove circle 17 which passes the bottoms of the grooves 13*a* ($a<b$). According to this configuration, when the sleeve 20 is fitted onto the cylindrical base portion 13, the apexes of the beads 1 of the sleeve 20 are collapsed by the bottoms of the grooves 13*a*, and the beads 21 are fitted into the grooves 13*a* so that the cylindrical base portion 13 is pressingly inserted into the sleeve 20, resulting in that the sleeve 20 is surely fitted onto and fixed to the cylindrical base portion 13 as shown in FIG. 7.

Under the state where the sleeve 20 is fitted onto the cylindrical base portion 13 as described above, even when a gap is formed between them by, for example, a small dimensional difference between the outer diameter d of the cylindrical base portion 13 and the inner diameter e of the sleeve 20, or when the annular step portion 13*b* (see FIG. 1) of the cylindrical base portion 13 is irregularly formed, the center aligning between the terminal insertion hole 20*a* of the sleeve 20 and the front ends of the elastic contact pieces 12 can be facilitated by the fitting of the beads 21 and the grooves 13*a* at the four locations.

In the embodiment, beads and grooves are formed at four locations. Alternatively, they are formed at three locations. In the invention, the numbers of the beads and grooves are not restricted. However, it is preferable to form in such a manner that the beads and grooves are arranged in the peripheral direction at substantially equal intervals.

As described above, according to the invention, a plurality of grooves elongating in the axial direction are formed on the outer face of the cylindrical base portion of the terminal body, and a plurality of beads respectively corresponding to the grooves are formed on the inner face of the sleeve. The grooves can be inserted along the respective beads. Therefore, the center aligning between the front ends of the elastic contact pieces and the terminal insertion hole is facilitated, and they are prevented from being misaligned. When female and male terminals are to be fitted, consequently, elastic contact pieces, etc. are prevented from being deformed or damaged. Since it is not required to set severe tolerances of the inner diameter of the sleeve and the outer diameter of the cylindrical base portion, furthermore, defectives which may be produced in a manufacturing process can largely be reduced in number.

What is claimed is:

1. A socket terminal comprising:

a terminal body having:

a cylindrical base portion in a front part, the cylindrical base portion having a plurality of elastic contact pieces which are separated from each other in a peripheral direction by slits extending in a longitudinal direction;

a wire connection portion in a rear part for connecting a wire thereto; and a circular cylindrical protection sleeve having a terminal insertion hole at a front part and a fitting portion at a rear part, the circular cylindrical protection sleeve being fitted onto the cylindrical base portion; and engaging means for engaging the circular cylindrical protection sleeve with the terminal body, wherein the engaging means includes:

a plurality of grooves formed on an outer face of the cylindrical base portion of the terminal body and extending in a substantially axial direction; and a plurality of beads formed on an inner face of the fitting portion of the circular cylindrical protection sleeve, said beads being received in said grooves respectively.

2. A socket terminal comprising:

a terminal body having:

a cylindrical base portion in a front part, the cylindrical base portion having a plurality of elastic contact pieces which are separated from each other in a peripheral direction by slits extending in a longitudinal direction;

a wire connection portion in a rear part for connecting a wire thereto; and a circular cylindrical protection sleeve having a terminal insertion hole at a front part and a fitting portion at a rear part, the circular cylindrical protection sleeve being fitted onto the cylindrical base portion; and engaging means for engaging the circular cylindrical protection sleeve with the terminal body, wherein the engaging means includes:

a plurality of grooves formed on an outer face of the cylindrical base portion of the terminal body; and a plurality of beads formed on an inner face of the fitting portion of the circular cylindrical protection sleeve, said beads being received in said grooves respectively, wherein the beads projecting from the inner face of the fitting portion of the circular cylindrical protection sleeve have elasticity.

3. A socket terminal comprising:

a terminal body having:

a cylindrical base portion in a front part, the cylindrical base portion having a plurality of elastic contact pieces which are separated from each other in a peripheral direction by slits extending in a longitudinal direction;

a wire connection portion in a rear part for connecting a wire thereto; and a circular cylindrical protection sleeve having a terminal insertion hole at a front part and a fitting portion at a rear part, the circular cylindrical protection sleeve being fitted onto the cylindrical base portion; and engaging means for engaging the circular cylindrical protection sleeve with the terminal body, wherein the engaging means includes:

a plurality of grooves formed on an outer face of the cylindrical base portion of the terminal body; and a plurality of beads formed on an inner face of the fitting portion of the circular cylindrical protection sleeve, said beads being received in said grooves respectively, wherein a diameter of a bead circle which passes through apexes of the beads is slightly smaller than a diameter of a groove circle which passes through bottoms of the grooves.

4. A socket terminal comprising:

a terminal body having:

a cylindrical base portion in a front part, the cylindrical base portion having a plurality of elastic contact pieces which are separated from each other in a peripheral direction by slits extending in a longitudinal direction;

a wire connection portion in a rear part for connecting a wire thereto; and a circular cylindrical protection sleeve having a terminal insertion hole at a front part and a fitting portion at a rear part, the circular cylindrical protection sleeve being fitted onto the cylindrical base portion; and engaging means for engaging the circular cylindrical protection sleeve with the terminal body, wherein the engaging means includes:

a plurality of grooves formed on an outer face of the cylindrical base portion of the terminal body; and a plurality of beads formed on an inner face of the fitting portion of the circular cylindrical protection sleeve, said beads being received in said grooves respectively, wherein the grooves and the beads are arranged in a peripheral direction at substantially equal intervals.

* * * * *